United States Patent [19]

Baigrie et al.

[11] Patent Number: 4,816,614

[45] Date of Patent: Mar. 28, 1989

[54] HIGH FREQUENCY ATTENUATION CABLE

[75] Inventors: Stephen M. Baigrie; Alan L. Brown, both of Swindon, England

[73] Assignee: Raychem Limited, London, England

[21] Appl. No.: 5,506

[22] Filed: Jan. 20, 1987

[30] Foreign Application Priority Data

Jan. 20, 1986 [GB] United Kingdom ..... 8601270

[51] Int. Cl.[4] ..... H01B 7/22

[52] U.S. Cl. ..... 174/36; 174/102 A; 174/103; 174/106 R; 174/109; 333/12

[58] Field of Search ..... 174/36, 102 A, 103, 174/109, 106 R; 333/12, 243; 342/1

[56] References Cited

U.S. PATENT DOCUMENTS

| | | | |
|---|---|---|---|
| 312,673 | 2/1885 | Thompson et al. | 174/36 |
| 1,586,884 | 6/1926 | Elmen | 174/36 |
| 2,147,095 | 2/1939 | Hochstadter | 174/103 |
| 2,243,851 | 6/1941 | Booth et al. | 174/36 |
| 2,319,744 | 5/1943 | Mougey | 174/36 |
| 2,669,695 | 2/1954 | Bird | 174/36 |
| 3,219,951 | 11/1965 | Clark | 174/36 |
| 3,240,867 | 3/1966 | Maddox | 174/109 |
| 3,886,506 | 5/1975 | Lorber et al. | 333/243 |
| 3,925,593 | 12/1975 | Kardashian | 174/36 |
| 4,126,287 | 11/1978 | Mendelsohn et al. | 174/35 MS X |
| 4,347,487 | 8/1982 | Martin | 333/12 X |
| 4,383,225 | 5/1983 | Mayer | 174/36 X |
| 4,449,013 | 5/1984 | Garschick | 174/103 |
| 4,510,468 | 4/1985 | Mayer | 333/12 |

FOREIGN PATENT DOCUMENTS

| | | | |
|---|---|---|---|
| 1269243 | 7/1961 | France | 174/36 |
| 21515 | 4/1968 | Japan | 174/36 |
| 284733 | 5/1928 | United Kingdom . | |
| 354734 | 8/1931 | United Kingdom . | |
| 394384 | 6/1933 | United Kingdom . | |
| 427322 | 4/1935 | United Kingdom . | |
| 502122 | 3/1939 | United Kingdom | 174/36 |

*Primary Examiner*—Morris H. Nimmo

*Attorney, Agent, or Firm*—Edith A. Rice; Herbert G. Burkard

[57] ABSTRACT

High frequency attenuation cable has a core surrounded by an EMI shielding layer. The core comprises at least one inner conductor, at least one high frequency absorption layer or non-amorphous magnetic metal tape surrounding, but not necessarily adjacent to, the inner conductor, and at least one dielectric layer surrounding, but not necessarily adjacent to, the inner conductor.

The constructions according to the invention enable improved attenuation at frequencies in the range of 10–100 MHz.

15 Claims, 3 Drawing Sheets

HIGH FREQUENCY ATTENUATION CABLE

This invention relates to high frequency attenuation cables and harness systems incorporating such cables.

The use of high frequency attenuation cables has increased over the past few years, and is now well known. These cables allow the passage of signals along the cable, but filter out high frequency energy which could otherwise interfere with the operation of the cable and/or associated equipment. They are especially useful in applications where, for example, high frequency electromagnetic interference (EMI), or radio waves may interfere with electronic instruments connected to the cable.

Known constructions of high frequency attenuation cables generally include a core comprising an inner conductor, a dielectric layer, a high frequency absorption layer generally comprising a ferrite-loaded polymer, and an EMI shielding layer surrounding the core. Either the dielectric layer or the ferrite-loaded polymer layer may be adjacent to the inner conductor. Examples of references disclosing a high frequency attenuation cable include European Patent Publication No. 0,049,639A, UK Patent Publication Nos. 2,089,103A and 2,113,456A, UK Patent No. 2,012,097B, and U.S. Pat. No. 4,301,428. Similar, but generally more complex constructions of conductors surrounded by a ferrite-loaded polymer layer or layers are described in U.S. Pat. No. 3,573,676. While these references disclose cables with adequate high frequency attenuation above 100 Megahertz (MHz), there is still the necessity to improve high frequency attenuation in the range of 10 to 100 MHz.

We have now discovered a cable construction that enables fequencies in the range of 10 to 100 MHz to be better attenuated. Accordingly, the present invention provides a high frequency attenuation cable having a core surrounded by an EMI shielding layer, the core comprising:

at least one inner conductor;

at least one high frequency absorption layer of non-amorphous magnetic metal tape surrounding, but not necessarily adjacent to, the inner conductor;

at least one dielectric layer surrounding, but not necessarily adjacent to, the inner conductor; and no EMI shielding layer within the core.

By "core" is meant the portion of a cable that is surrounded by an EMI shielding layer, or if more than one shielding layer, the shielding layer nearest to the inner conductor. The layers contained in a core usually (though not inevitably) surround one central conductor.

It has been found that when the cable core of a high frequency attenuation cable includes a layer of magnetic metal tape the performance of the cable is surprisingly and unexpectedly improved, with good attenuation occuring from a frequency of 10 MHz upwards.

The magnetic metal tape layer is preferably either a braid or a helically wound wrap. By "tape" is meant a long, flexible strip, wherein the ratio of strip width to strip thickness is at least 10:1, especially at least 20:1.

The actual dimensions of the tape depend upon, for example, the way in which the tape surrounds the central conductor and the diameter of the central conductor, which is generally between 10 and 26 AWG (2.59 and 0.41 mm). Generally the tape is less than 50 micrometers thick and less than 4 mm wide. For example, when the tape is helically wound round a conductor of 18 to 24 AWG (1.02 to 0.51 mm) typical dimensions are between 20 and 40 micrometers thick and between 0.5 and 3.0 mm wide. When the tape is braided the dimensions are generally smaller, for example between 10 and 30 micrometers thick and between 0.2 and 1.5 mm wide.

A tape is preferred rather than any other form because, for example, it is more flexible than a solid metal layer and lighter in weight than a helically wrapped or braided wire of square or circular cross-section for the same surface coverage.

The magnetic metal tape is preferably magnetically soft, although some degree of hardness can be included as, for example, in some steels. Suitable magnetic materials include ferromagnetic materials, nickel, iron, nickel-iron alloys, silicon-iron alloys, cobalt-iron alloys and steel. The steels are chosen to be those which are naturally ferromagnetic or become ferromagnetic due to processing. Nickel-iron alloys are especially preferred, for example mumetal, permalloy, supermalloy, supermumetal, nilomag, sanbold etc., one of which is used in, for example, high frequency radio interferenece suppressors for I.C. engine ignition systems, as described in U.S. Pat. No. 1,984,526.

The magnetic metal tape layer of the present invention may be adjacent to the central conductor, that is to say it is directly wound or braided onto, and preferably in contact with, the conductor. Alternatively the dielectric layer may be adjacent to the central conductor, with the metal tape then surrounding this dielectric layer.

The dielectric layer is preferably continuous, at least in the direction along the longitudinal axis of the conductor, and the material used for this layer may be selected from ay of the known dielectric materials usually used in cable constructions. These include, for example, Tefzel TM which is a copolymer of ethylene and tetrafluoroethylene (available from E. I. DuPont de Nemours); Mylar TM which is polyethyleneteraphthalate (available from E. I. DuPont de Nemours); Kynar TM which is polyvinylidene fluoride (available for Pennwalt Corporation); and polyethylene.

It has been found that the provision of a magnetic metal tape layer in the core of the cable gives good attenuation between 10 and 100 MHz, but that the attenuation above 100 MHz is improved if the core also contains a magnetic absorption layer comprising a polymer filled with magnetic particles such as ferrite particles. The preferred polymer for this second magnetic layer is Viton TM which is a copolymer of vinylidene fluoride and hexafluoropropylene (available for E. I. DuPont de Nemours).

Thus in a preferred embodiment of the present invention the cable core comprises a central conductor, surrounded by a layer of magnetic metal tape (wrapped or braided), a dielectric layer and a polymeric layer loaded with magnetic particles.

The layers surrounding the central conductor may be in any order and more than one layer of each type may be included in the core. In particular, a dielectric layer may separate the central conductor from the magnetic layer, and may also separate the two magnetic layers from each other. Alternatively the magnetic layers may be adjacent to each other.

The core is surrounded by one or more EMI shielding layers to prevent external interference from entering the core. It is, of course, contemplated within the scope of the invention that the cable construction may include any other layers of material commonly included in cables of this type. For example, the EMI shielding layer is generally surrounded by an outer jacket which may be insulating or conductive.

The cable according to the present invention may be a single coaxial cable, or multicore cable or a multicore coaxial cable. With multicore cable constructions or in harness systems it is often advantageous to surround the EMI shielding layer with a conductive outer jacket to reduce or eliminate "sneak paths" by which high frequency signals may travel along the cable without significant attenuation. In a multicore construction an EMI shielding layer may surround each individual core and/or may surround all the cores together in one outer layer. One or more of the cables according to the present invention may be incorporated into a harness system.

Various embodiments of the invention will now be described, by way of example only, with reference to the accompanying drawings, wherein.

Figure 9:
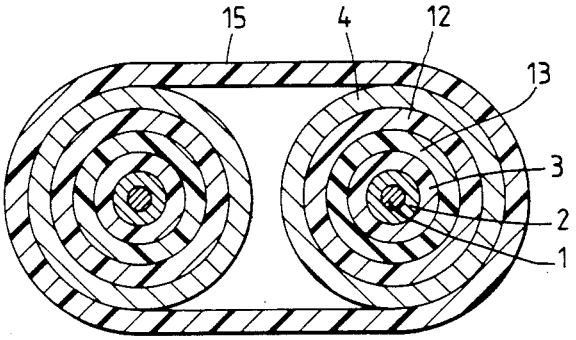
Figure 10:
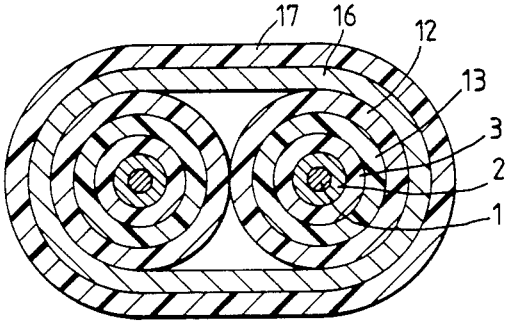
Figure 11:
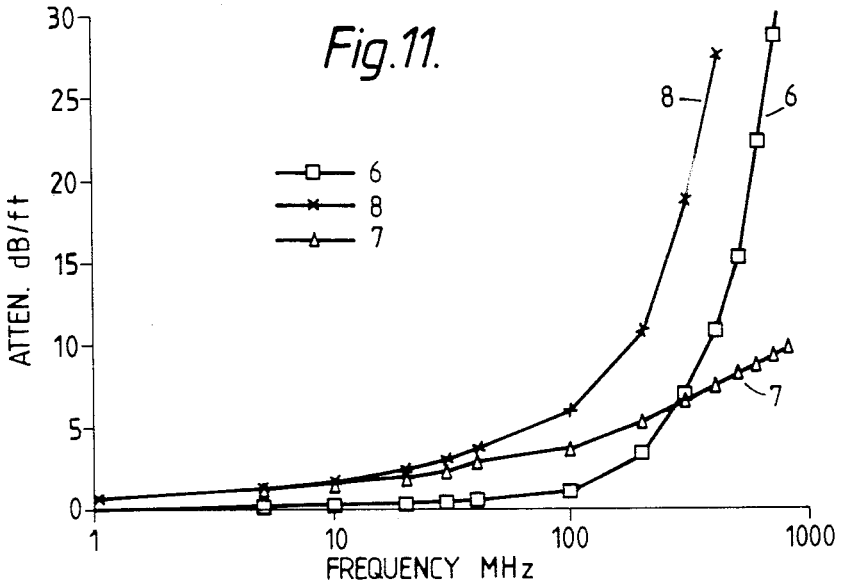

FIGS. 9 and 10 each show a cross-sectional view of a multicore cable construction incorporating cable cores according to the present invention; and FIG. 11 is a graph showing the improved attenuation obtained from high frequency attenuation cables according to the present invention compared with a known high frequency attenuation cable.

Figure 1:
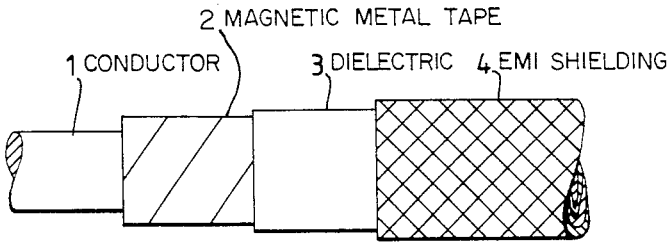
FIG. 1 shows a cable according to the present invention.

Referring to the drawings, FIG. 1 shows a cable according to the present invention wherein the core comprises a central electrical conductor 1 generally made of solid copper or stranded copper wire, a magnetic metal tape layer 2 such as mumetal, and a dielectric layer 3 such as Tefzel. The positions of layers 2 and 3 may be interchanged such that the tape 2 surrounds the dielectric 3. An EMI shielding layer 4 such as copper braid surrounds the cable core.

Figure 2:
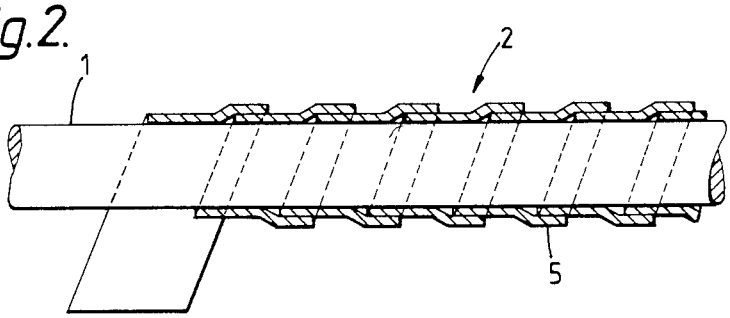
FIGS. 2 to 4 illustrate different arrangements of the magnetic metal layer in the cable core.
Figure 3:
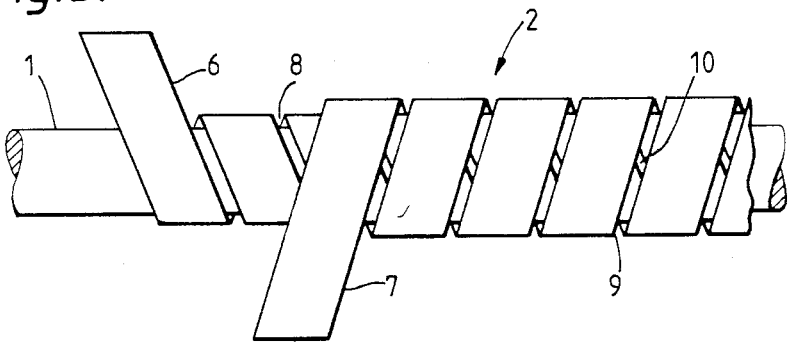
Figure 4:
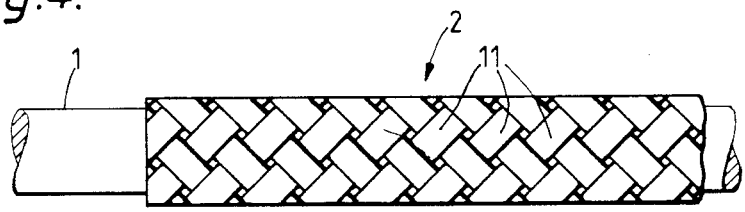

The magnetic metal tape layer may be in a number of different arrangements and some examples are given in FIGS. 2, 3 and 4, in which the tape layer is generally referred to by the numeral 2. In FIG. 2 the layer 2 comprises a tape helically wrapped around the conductor 1, each successive winding overlapping the previous winding to give swaged overlap regions 5. In FIG. 3 the magnetic metal layer 2 comprises two tape layers 6 and 7. The first layer 6 is helically wound around the conductor in a butt-wrap with small spaces 8 between each winding. The second layer 7 is wound around the first layer 6, also in a butt-wrap with spaces 9 between adjacent windings, but in an opposite sense to the first layer 6, thus forming a series of small diamond-shaped holes 10 in the completed magnetic metal layer. Alternatively the second layer 7 can be wound so that it covers the spaces 8 between adjacent windings in the first layer. In FIG. 4 the magnetic metal layer is in the form of a number of magnetic metal tapes 11 braided together.

The following example describes a number of cable constructions according to the present invention, each construction differing in its arrangement of the magnetic metal tape layer. The attenuation of each of these cable constructions was measured.

EXAMPLE 1

Three cables were constructed as follows:

Cable 1: (a) A 20 AG (0.96 mm diameter) central conductor comprising stranded nickel plated copper;

(b) a single layer of magnetic metal comprising mumetal tape of dimensions 1.5 mm×0.05 mm helically wound around, and in contact with, the central conductor, in the form of a butt-wrap with a small spacing of less than 0.5 mm between each adjacent winding;

(c) a dielectric layer comprising a single layer of polyethylene tubing heat-recovered on to the mumetal layer; and (d) a copper braid surrounding the dielectric layer.

Cable 2: identical to cable 1 except that a second mumetal tape was helically wound over the first mumetal tape layer, the second layer also being in the form of a butt-wrap with a small spacing between each adjacent winding, but wound in the opposite sense to the first layer (as illustrated in FIG. 2). Thus the conductor was visible through small diamond-shaped holes in the mumetal layer.

Cable 3: identical to cable 2 except that the second mumetal tape was wound in the same sense as the first layer, the second tape being wound such that it substantially covered the gaps between the windings in the first layer. Thus no conductor was visible through the mumetal layer.

The attenuation of each cable construction was tested by measuring insertion loss up to 40 MHz using a Hewlett Packard 3585A Spectrum Analyser. The results are given in Table 1 below.

TABLE 1

| FREQUENCY | CABLE 1 | | CABLE 2 | | CABLE 3 | |
|---|---|---|---|---|---|---|
| MHz | dB/ft | dB/m | dB/ft | dB/m | dB/ft | dB/m |
| 0.5 | 0.07 | 0.22 | 0.37 | 1.22 | 0.21 | 0.68 |
| 1.0 | 0.13 | 0.42 | 0.46 | 1.50 | 0.36 | 1.18 |
| 5.0 | 0.42 | 1.37 | 0.87 | 2.86 | 0.85 | 2.77 |
| 10.0 | 0.63 | 2.06 | 1.25 | 4.10 | 1.23 | 4.04 |
| 20.0 | 0.81 | 2.66 | 1.51 | 4.94 | 1.64 | 5.37 |
| 30.0 | 1.01 | 3.32 | 1.85 | 6.08 | 2.03 | 6.66 |
| 40.0 | 1.36 | 4.46 | 2.43 | 7.96 | 2.66 | 8.71 |

These results show good attenuation for all constructions, but that a double layer of magnetic metal tape is preferable to a single layer. Surprisingly there was substantially no difference in the attenuation of cable 2 and 3, indicating that small holes in the magnetic metal layer do not adversely affect the degree of attenuation and thus complete coverage of the conductor by the magnetic metal is not essential.

The attenuation of a cable construction incorporating magnetic metal tape according to the present invention was compared with that of a cable construction in which the core incorporated a layer of magnetic metal wire. This is illustrated by the following Example 2.

EXAMPLE 2

Two cables were constructed as follows:

Cable 4: (a) A 20 AWG (0.96 mm diameter) central conductor comprising stranded nickel plated copper;

(b) a single layer of bright annealed 34 SWG (0.23 mm diameter) mumetal wire of circular cross-section helically wound around, and in contact with, the central conductor, such that adjacent windings were in contact with each other or had only a small space between them;

(c) a dielectric layer comprising a single layer of polethylene tubing heat-recovered onto the mumetal layer; and (d) a copper braid surrounding the dielectric layer.

Cable 5: identical to cable 4 except that the mumetal layer comprised a single layer of tape of dimensions 1.0 mm×0.04 mm helically wound around, and in contact with, the central conductor, in the form of a butt wrap with only small spacings of less than 0.4 mm between adjacent windings. The tape was obtained by flattening the mumetal wire used in cable 5 followed by a bright anneal to restore the magnetic properties damaged by the flattening process.

The attenuation of each cable construction was tested by measuring insertion loss up to 40 MHz using a Hewlett Packard 3585A Spectrum Analyser. The results are given in the following Table 2.

TABLE 2

| FREQUENCY | CABLE 1 | | CABLE 2 | |
|---|---|---|---|---|
| MHz | dB/ft | dB/m | dB/ft | dB/M |
| 0.5 | 0.24 | 0.79 | 0.21 | 0.68 |
| 1.0 | 0.35 | 1.14 | 0.39 | 1.27 |
| 5.0 | 0.84 | 2.76 | 1.01 | 3.32 |
| 10.0 | 1.24 | 4.07 | 1.39 | 4.55 |
| 20.0 | 1.86 | 6.10 | 1.76 | 5.77 |
| 30.0 | 2.48 | 8.13 | 2.10 | 6.89 |
| 40.0 | 3.33 | 10.91 | 2.71 | 8.88 |

It would be generally expected that cable 5 would show a higher degree of attenuation than cable 6 as the former has a considerably thicker layer of magnetic metal, the metal being in the form of a wire rather than tape. Surprisingly, however, very little difference in attenuation between the two constructions was recorded. A tape is therefore highly preferable to a wire as it is considerably lighter in weight, and, in many instances, quicker to wrap around a conductor in the cable manufacture.

In addition to FIG. 1, various different cable constructions are envisaged with the scope of the present invention. A number of these are illustrated in FIGS. 5 to 8.

Figure 5:
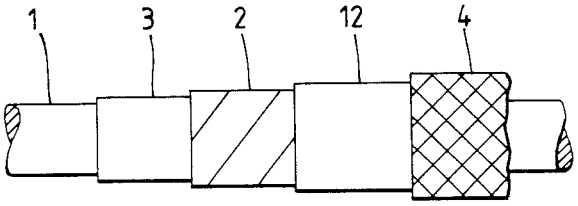
FIGS. 5 to 8 show various coaxial cable constructions according to the present invention.

In FIG. 5 the cable core comprises a central conductor 1, a dielectric layer 3, a helically wound or braided magnetic metal tape layer 2 and an additional dielectric layer 12. A copper braid 4, which provides the shielding layer, surrounds the core.

Figure 6:
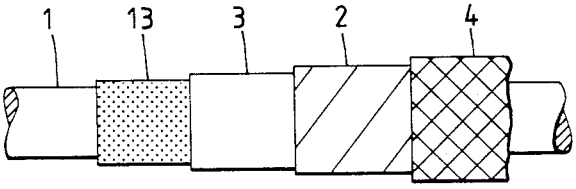

FIG. 6 illustrates a preferred embodiment according to the present invention, wherein the core includes a second magnetic lossy layer in addition to the magnetic metal tape. The core comprises a conductor 1, a magnetic polymer layer 13 usually comprising ferrite-loaded Viton, a dielectric layer 3 and a magnetic metal tape layer 2. A copper braid 4 surrounds the core. An additional dielectric layer (not shown) may be included between the tape 2 and braid 4.

Figure 7:
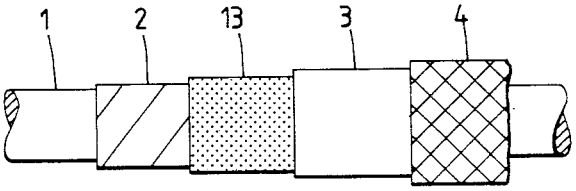

FIG. 7 shows a similar construction to that of FIG. 6 but with the core layers in a different arrangement. Here the core comprises a central conductor 1, a magnetic metal tape layer 2, a magnetic polymer layer 13 and a dielectric layer 3. A copper braid 4 surrounds the core. One or more additional dielectric layers (not shown) may be included between the conductor 1 and tape 2 and between the tape 2 and magnetic polymer 13 respectively.

Figure 8:
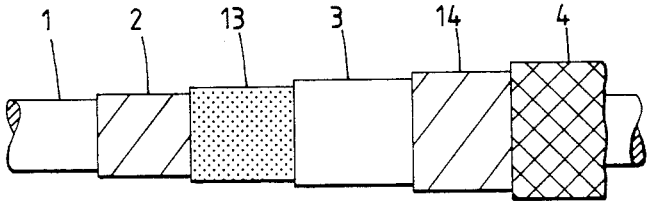

FIG. 8 shows another embodiment wherein the core contains two magnetic metal tape layers. Thus the core comprises a central conductor 1, a first magnetic metal tape layer 2, a magnetic polymer layer 13, a dielectric layer 3 and a second magnetic metal tape layer 14. A copper braid 4 surrounds the core. Additional dielectric layers may be included in the core if desired.

In each of the above FIGS. 5 to 8 one or more outer jackets may surround the braided shielding layer 4.

Two multi-core cable constructions are shown in FIGS. 9 and 10. The cores in each cable may be any of the cores exemplified above. The particular emodiment shown in FIG. 9 comprises two cores, each core comprising a central conductor 1, a magnetic metal tape layer 2, a dielectric layer 3, a magnetic polymer layer 13 and a second dielectric layer 12. A braided EMI shielding layer 4 surrounds each core and the two cores are surrounded together by an outer insulating jacket 15.

In FIG. 10 the cables are not each individually surrounded by an EMI shielding layer, but a gross EMI shielding layer, in the form of a braid, surrounds both cables. An outer jacket 17 then surrounds the shielding layer.

The improved performance of cables according to the present invention compared with known high frequency attenuation cables is illustrated by the following Example 3.

EXAMPLE 3

Three cables were tested and were of the following construction:

Cable 6: a 60 cm length of "Electro Loss TM Filter Line" cable (available from Raychem Ltd). This known cable comprised, in the following order:

(a) A 24 AWG (0.60 mm diameter) central conductor comprising stranded, silver coated copper alloy;

(b) a magnetic polymeric layer of approximately 0.15 mm thickness comprising ferrite-loaded Viton;

(c) a dielectric layer of approximately 0.15 mm thickness comprising cross-linked Tefzel; and (d) a copper braid surrounding the dielectric layer.

Cable 7: a 60 cm length of cable according to the present invention, comprising:

(a) a central conductor as in cable 6;

(b) a dielectric layer of approximately 0.30 mm thickness comprising cross-linked Tefzel;

(c) a magnetic metal layer comprising a double wrap of mumetal tape. The tape was of dimensions 1.0 mm×0.025 mm and each layer was in the form of a helical butt wrap with a small spacing of 0.05 mm–0.20 mm between adjacent windings and the second or outer wrap was wound in the opposite sense to the inner wrap; and (d) a copper braid surrounding the magnetic metal layer.

Cable 8: a 60 cm length of cable according to the present invention comprising:

(a) a central conductor as in cable 6;

(b) a magnetic polymeric layer as in cable 6;

(c) a dielectric layer as in cable 6;

(d) a magnetic metal layer as in cable 7; and (e) a copper braid surrounding the magnetic metal layer.

The attenutation layer of each cable was tested by measuring insertion loss at various frequencies using a Hewlett Packard 3585A Spectrum Analyser (up to 40 MHz) and a Wiltron 560 Scaler Network Analyser (10 MHz–1 GHz). The results are given in graphical form in FIG. 11. These results show that for cable 6, which is the known construction incorporating a layer of magnetic polymeric material as the absorptive layer in the cable core, good attenuation occurs above 100 MHz, but only poor, if any, attenuation occurs below 100 MHz. For cable 7, which incorporates a magnetic metal absorptive layer in the cable core rather than a magnetic polymeric layer, good attenuation occurs between 10 MHz and 100 MHz indicating the improved performance obtained from a cable according to the present invention However, above 100 MHz the attenuation does not increase rapidly. Cable 8 combines the absorptive layers of cables 6 and 7 and thus incorporates in its core both a layer of magnetic polymeric material and a layer of magnetic metal. This is a preferred embodiment of the present invention and, as can be seen from FIG. 11, good attenuation occurs at all frequencies upwardly from 10 MHz. Most surprisingly, the attenuation occuring in cable 6 is better than the addition of the attenuation of cable 6 and cable 7. This indicates that, not only does the magnetic metal tape greatly improve the attenuation between 10 and 100 MHz, but that considerably improved attenuation is also obtained above 100 MHz.

We claim:

1. A high frequency attenuation cable which comprises a core comprising:

at least one inner conductor;

at least one high frequency absorption layer of non-amorphous magnetic metal tape surrounding the inner conductor;

at least one dielectric layer surrounding the inner conductor; and a second high frequency absorption layer comprising a polymeric material filled with magnetic particles surrounding the conductor;

and an EMI shielding layer surrounding the core, the first high frequency absorption layer being adjacent to the inner conductor.

2. A high frequency attenuation cable according to claim 1 wherein the magnetic metal tape layer is in the form of a helical warp.

3. A high frequency attenuation cable according to claim 2 wherein the magnetic metal tape layer comprises a double layer of helically wrapped tape.

4. A high frequency attenuation cable according to claim 1 wherein the magnetic metal tape layer is in the form of a braid.

5. A high frequency attenuation cable according to claim 1 wherein the magnetic tape layer comprises a nickel-iron alloy.

6. A high frequency attenuation cable according to claim 1 wherein the second high frequency absorption layer comprises a ferrite-loaded polymer.

7. A high frequency attenuation cable comprising a plurality of cores, each core comprising:

at least one inner conductor;

at least one high frequency absorption layer of non-amorphous magnetic metal tape surrounding the inner conductor;

at least one dielectric layer surrounding the inner conductor; and a second high frequency absorption layer comprising a polymeric material filled with magnetic particles surrounding the conductor;

and a common EMI shielding layer surrounding the plurality of cores, the first high frequency absorption layer of each of said cores being adjacent to the inner conductor.

8. A high frequency attenuation cable according to claim 7 wherein the magnetic tape layer comprises a nickel-iron alloy.

9. A high frequency attenuation cable according to claim 7 wherein the second high frequency absorption layer comprises a ferrite-loaded polymer.

10. A high frequency attenuation cable which comprises a core comprising:

at least one inner conductor;

at least one high frequency absorption layer of non-amorphous magnetic metal tape surrounding the inner conductor;

at least one dielectric layer surrounding the inner conductor; and a second high frequency absorption layer comprising a polymeric material filled with magnetic particles surrounding the conductor;

and an EMI shielding layer surrounding the core, the first high frequency absorption layer being adjacent to the EMI shielding layer.

11. A high frequency attenuation cable according to claim 10 wherein the magnetic tape layer comprises a nickel-iron alloy.

12. A high frequency attenuation cable according to claim 10 wherein the second high frequency absorption layer comprises a ferrite-loaded polymer.

13. A high frequency attenuation cable according to claim 10 wherein the magnetic metal tape layer is in the form of a helical wrap.

14. A high frequency attenuation cable according to claim 13 wherein the magnetic metal tape layer comprises a double layer of helically wrapped tape.

15. A high frequency attenuation cable according to claim 10 wherein the magnetic metal tape layer is in the form of a braid.

* * * * *